US009441301B2

(12) United States Patent
Shahjamali et al.

(10) Patent No.: US 9,441,301 B2
(45) Date of Patent: Sep. 13, 2016

(54) METHOD FOR FORMING A BIMETALLIC CORE-SHELL NANOSTRUCTURE

(71) Applicant: Nanyang Technological University, Singapore (SG)

(72) Inventors: Mohammad Mehdi Shahjamali, Singapore (SG); Can Xue, Singapore (SG); Yin Chiang Freddy Boey, Singapore (SG)

(73) Assignee: Nanyang Technological University, Singapore (SG)

( * ) Notice: Subject to any disclaimer, the term of this patent is extended or adjusted under 35 U.S.C. 154(b) by 0 days.

(21) Appl. No.: 14/099,626

(22) Filed: Dec. 6, 2013

(65) Prior Publication Data

US 2014/0162067 A1 Jun. 12, 2014

Related U.S. Application Data

(60) Provisional application No. 61/734,139, filed on Dec. 6, 2012.

(51) Int. Cl.
*C23C 18/44* (2006.01)
*C23C 18/16* (2006.01)

(52) U.S. Cl.
CPC ..... *C23C 18/44* (2013.01); *C23C 18/165* (2013.01); *C23C 18/1635* (2013.01); *C23C 18/1637* (2013.01); *Y10T 428/2991* (2015.01)

(58) Field of Classification Search
None
See application file for complete search history.

(56) References Cited

PUBLICATIONS

Srnova-Sloufova et al, Langmuir 20 pp. 3407-3415, 2004.*
Moskovits et al, Journal of Chemical Physics, 116(23), pp. 10435-10446, 2002.*
Jin et al, J. Phys. Chem. 107, pp. 12902-12905, 2003.*
Zhao et al, Colloids and Surfaces A: Physicochemical and Engineering Apects, 386, pp. 172-178, 2011.*
Yuan et al, The Journal of Physical Chemistry, 115, pp. 23256-23260, published Oct. 2011.*
Aherne et al., "Etching-Resistant Silver Nanoprisms by Epitaxial Deposition of a Protecting Layer of Gold at the Edges," *Langmuir* 25(17):10165-10173, 2009.
Aherne et al., "From Ag Nanoprisms to Triangular AuAg Nanoboxes," *Advanced Functional Materials* 20:1329-1338, 2010.
Beck et al., "Tunable light trapping for solar cells using localized surface plasmons," *Journal of Applied Physics 105*:114310-114317, 2009.
Chen et al., "Dependence of Fluorescence Intensity on the Spectral Overlap between Fluorophores and Plasmon Resonant Single Silver Nanoparticles," *Nano Letters* 7(3):690-696, 2007.
Chen et al., "Magnetoelectrochemistry of Gold Nanoparticle Quantized Capacitance Charging," *J. Am. Chem. Soc. 124*:5280-5281, 2002.
Chen et al., "Plasmonic Focusing in Rod-Sheath Heteronanostructures," *ACS Nano 3*(1):87-92, 2009.
Hasobe et al., "Photovoltaic Cells Using Composite Nanoclusters of Porphyrins and Fullerenes with Gold Nanoparticles," *J. Am. Chem. Soc. 127*:1216-1228, 2005.

(Continued)

*Primary Examiner* — Erma Cameron
(74) *Attorney, Agent, or Firm* — Seed IP Law Group PLLC

(57) ABSTRACT

A method forms a bimetallic core-shell nanostructure. The bimetallic core-shell nanostructure comprises a core comprising silver and a shell comprising gold. The bimetallic core-shell nanostructure may be used in various technical fields, such as surface-enhanced Raman scattering (SERS), photovoltaic cells, biomedical, bioimaging and biosensing applications.

9 Claims, 10 Drawing Sheets

(56) References Cited

PUBLICATIONS

Huang et al., "Photochemically Controlled Synthesis of Anisotropic Au Nanostructures: Platelet-like Au Nanorods and Six-Star Au Nanoparticles," *ACS Nano 4*(10):6196-6202, 2010.
Jiang et al., "Catalytic Properties of Silver Nanoparticles Supported on Silica Spheres," *J. Phys. Chem. B. 109*:1730-1735, 2005.
Kelly et al., "The Optical Properties of Metal Nanoparticles: The Influence of Size, Shape, and Dielectric Environment," *J. Phys. Chem. B. 107*:668-677, 2003.
Kulkarni et al., "Plasmon-Enhanced Charge Carrier Generation in Organic Photovoltaic Films Using Silver Nanoprisms," *Nano Letters 10*:1501-1505, 2010.
Lakowicz et al., "Radiative decay engineering 5: metal-enhanced fluorescence and plasmon emission," *Analytical Biochemistry 337*:171-194, 2005.
Langille et al., "Bottom-Up Synthesis of Gold Octachedra with Tailorable Hollow Features," *J. Am. Chem. Soc. 133*:10414-10417, 2011.
Liz-Marzan, "Tailoring Surface Plasmons through the Morphology and Assembly of Metal Nanoparticles," *Langmuir 22*:32-41, 2006.
Métraux et al., "Triangular Nanoframes Made of Gold and Silver," *Nano Letters 3*(4):519-522, 2003.
Millstone et al., "Colloidal Gold and Silver Triangular Nanoprisms," *Small 5*(6):646-664, 2009.
Millstone et al., "Controlling the Edge Length of Gold Nanoprisms via a Seed-Mediated Approach," *Advanced Functional Materials 16*:1209-1214, 2006.
Mulvihill et al., "Anisotropic Etching of Silver Nanoparticles for Plasmonic Structures Capable of Single-Particle SERS," *J. Am. Chem. Soc. 132*:268-274, 2010.
Murphy et al., "Anisotropic Metal Nanoparticles: Synthesis, Assembly, and Optical Applications," *J. Phys. Chem. B. 109*:13857-13870, 2005.
Niu et al., "Selective Synthesis of Single-Crystalline Rhombic Dodecahedral, Octahedral, and Cubic Gold Nanocrystals," *J. Am. Chem. Soc. 131*:697-703, 2009.
Novo et al., "Charge-Induced Rayleigh Instabilities in Small Gold Rods," *Nano Letters 7*(2):520-524, 2007.
Peng et al., "A Facile Synthesis of Monodisperse Au Nanoparticles and Their Catalysis of co Oxidation," *Nano Res 1*:229-234, 2008.
Pyayt et al., "Integration of photonic and silver nanowire plasmonic waveguides," *Nature Nanotechnology 3*:660-665, Nov. 2008.
Sanedrin et al., "Seed-Mediated Growth of Bimetallic Prisms," *Adv. Mater. 17*(8):1027-1031, Apr. 18, 2005.
Seo et al., "Shape Adjustment between Multiply Twinned and Single-Crystalline Polyhedral Gold Nanocrystals: Decahedra, Icosahedra, and Truncated Tetrahedra," *J. Phys. Chem. C. 112*:2469-2475, 2008.
Sun et al., "Crystalline Silver Nanowires by Soft Solution Processing," *Nano Letters 2*(2):165-168, 2002.
Sun et al., "Mechanistic Study on the Replacement Reaction between Silver Nanostructures and Chloroauric Acid in Aqueous medium" *J. Am. Chem. Soc. 126*:3892-3901, 2004.
Tsuji et al., "Shape-Dependent Evolution of Au@Ag Core—Shell Nanocrystals by PVP-Assisted N,N-Dimethylformamide Reduction," *Crystal Growth & Design 8*(7):2528-2536, 2008.
Wiley et al., "Maneuvering the Surface Plasmon Resonance of Silver Nanostructures through Shape-Controlled Synthesis," *J. Phys. Chem. B. 110*:15666-15675, 2006.
Wiley et al., "Right Bipyramids of Silver: A New Shape Derived from Single Twinned Seeds," *Nano Letters 6*(4):765-768, 2006.
Xie et al., "Colorimetric Detection of HIV-$_1$ Ribonuclease H Activity by Gold Nanoparticles," *Small 7*(10):1393-1396, 2011.
Xue et al., "pH-Switchable Silver Nanoprism Growth Pathways," *Angew. Chem. 119*:2082-2084, 2007.
Xue et al., "Plasmon-Driven Synthesis of Triangular Core—Shell Nanoprisms from Gold Seeds," *Angew. Chem. Int. Ed. 46*:8436-8439, 2007.
Xue et al., "Self-Assembled Monolayer Mediated Silica Coating of Silver Triangular Nanoprisms," *Adv. Mater. 19*:4071-4074, 2007.
Yang et al., "Turning the Intensity of Metal-Enhanced Fluorescence by Engineering Silver Nanoparticle Arrays," *Small 6*(9):1038-1043, 2010.
Zhang et al., "Synthesis of Silver Nanorods by Low Energy Excitation of Spherical Plasmonic Seeds," *Nano Letters 11*:2495-2498, 2011.
Zhou et al., "In Situ Synthesis of Metal Nanoparticles on Single-Layer Graphene Oxide and Reduced Graphene Oxide Surfaces," *J. Phys. Chem. C. 113*(25):10842-10846, 2009.
Zou et al., "Preparation of novel silver-gold bimetallic nanostructures by seeding with silver nanoplates and application in surface-enhanced Raman scattering," *Journal of Colloid and Interface Science 306*:307-315, 2007.

* cited by examiner (a)

(b)

METHOD FOR FORMING A BIMETALLIC CORE-SHELL NANOSTRUCTURE

CROSS-REFERENCE TO RELATED APPLICATION

This application claims the benefit of priority of United States of America Provisional Patent Application No. 61/734,139, filed Dec. 6, 2012, the contents of which being hereby incorporated by reference in its entirety for all purposes.

TECHNICAL FIELD

The invention relates to a method for forming a bimetallic core-shell nanostructure. The bimetallic core-shell nanostructure comprises a core comprising silver and a shell comprising gold. The bimetallic core-shell nanostructure may be used in various technical fields, such as surface-enhanced Raman scattering (SERS), photovoltaic cells, biomedical, bioimaging and biosensing applications.

BACKGROUND

Shape-controlled nanostructure synthesis of noble metals, such as silver and gold in particular, has attracted a great deal of attention in recent years because of their unusual optical properties known as localized surface plasmon resonance (LSPR), as well as their novel chemical, electronic, and catalytic properties. Consequently, a broad range of intriguing applications capitalising on such unique nanostructures properties have emerged in the field of photonics, catalysis, biological and chemical sensing, surface-enhanced Raman scattering (SERS), metal-enhanced fluorescence (MEF), and energy conversion.

The need to produce nanoparticles (NPs) with finely-tuned optical properties has led to enormous research efforts on developing reliable routes to synthesize noble metal NPs with controllable sizes and shapes, such as sphere, rod, wire, prism, cube, octahedron, star, icosahedron, and bipyramid.

Bimetallic silver (Ag) and gold (Au) nanocrystals are particularly attractive because they possess broader range of plasmon tunability and versatile surface functionality as compared to the individual unit of Ag or Au nanocrystal. By combining Au and Ag into core-shell structures, the resultant LSPR signatures can be controlled by not only varying the size and shape of the core but also the shell thickness. The close lattice match between Au and Ag (<0.3% mismatch) plays a key role in achieving conformal epitaxial growth. For example, Au@Ag core-shell nanocrystals with various morphologies have been synthesized through an epitaxial growth process involving conformal Ag deposition on the surface of Au seeds.

However, the formation of a bimetallic nanostructure with a Ag core and a Au shell remains challenging due to the significant etching of the Ag core by Au salt precursors, which is known as galvanic replacement. In particular, when the core is a Ag nanoprism with very small thickness (<10 nm), the tips and edges are so vulnerable to oxidation and the flat (111) faces tend to be preferentially etched through the galvanic process. For example, by seeding with Ag nanoplates, bimetallic Ag@Au nanostructures with non-uniform gold coating and pinholes in the structure were produced. In another example, rounded-tip triangular Ag@Au core-shell nanostructures with corrugated gold shells were produced by using cetyltrimethylammonium bromide (CTAB) as the surfactant to mitigate Ag prism etching. However, the presence of CTAB led to severe tip truncation of the Ag prism cores. More seriously, the strong passivation of gold shell surfaces by CTAB induces tremendous difficulties when further surface modification is needed for application purposes.

Therefore, there remains a need to provide for a method for forming a bimetallic core-shell nanostructure that overcomes, or at least alleviates, the above problems.

SUMMARY

Present inventors have provided a method for forming a bimetallic core-shell nanostructure by coating a silver core with a layer of gold (i.e. shell) using mild reducing agents. Advantageously, the shape of the silver core is preserved with minimal etching of the silver core by gold precursor ions. The method is a straightforward seed-mediation approach that involves reduction of the gold salt precursor ions on the silver core. The reaction is very mild to ensure epitaxial Au growth on the Ag core and at the same time ensure that the reduction of the gold precursor ions only occurs on the surface of Ag core seeds while avoiding spontaneous nucleation of Au nanoparticles in the solution. In addition, it is notable that the reducing agent exhibits little etching of Ag and Au nanocrystals compared to other conventional reducing agents such as ascorbic acid.

Accordingly, one aspect of the invention provides a method for forming a bimetallic core-shell nanostructure, wherein the core comprises silver and the shell comprises gold. The method includes simultaneously adding a gold precursor and a reducing agent to a solution containing silver nanoparticles. The reducing agent includes hydroxylamine solution or a hydroxylamine salt.

The bimetallic core-shell nanostructures formed by the present method may be used in surface-enhanced Raman scattering (SERS), photovoltaic cells, biomedical, bioimaging and biosensing applications.

BRIEF DESCRIPTION OF THE DRAWINGS

In the drawings, like reference characters generally refer to the same parts throughout the different views. The drawings are not necessarily drawn to scale, emphasis instead generally being placed upon illustrating the principles of various embodiments. In the following description, various embodiments of the invention are described with reference to the following drawings.

DESCRIPTION

Figure 1:
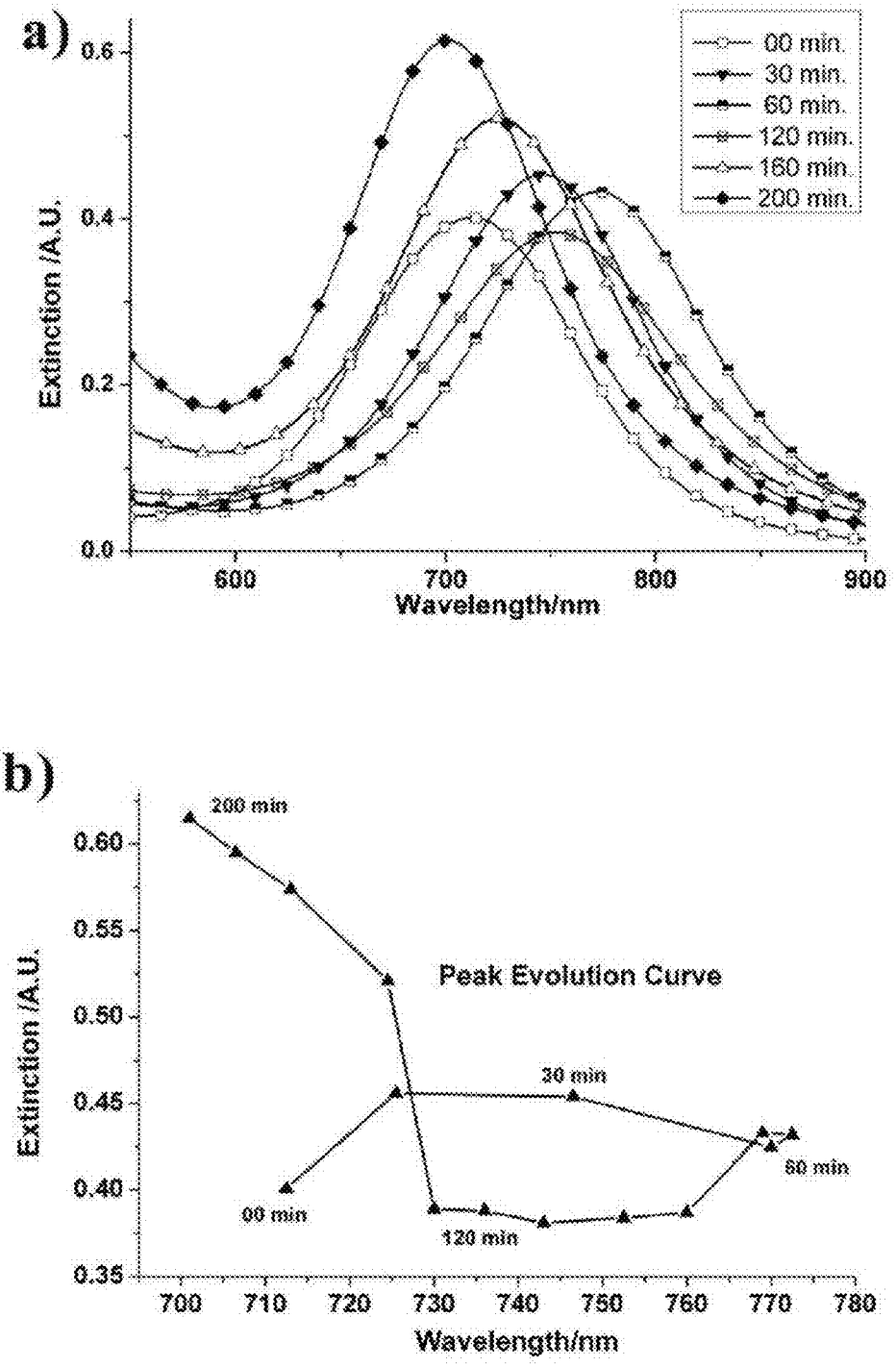
FIG. 1 shows UV-Vis extinction spectra during the gold coating process. a) Spectra of samples from 0 to 200 minutes. b) Peak evolution curve of A (each point of this diagram corresponds to λmax of the solution at a different time).

The following detailed description refers to the accompanying drawings that show, by way of illustration, specific details and embodiments in which the invention may be practised. These embodiments are described in sufficient detail to enable those skilled in the art to practise the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

Although the vulnerablility of thin nanostructures makes the shape-controlled gold-coating process extremely challenging, targeting a nanostructure with a Ag nanoprism core and controllable Au shell thickness is very attractive since the surface plasmon resonance (SPR) wavelength of Ag nanoprisms can be finely tuned through the entire visible spectrum and even part of the near-IR range. The ideal gold coating would provide significantly enhanced stability and allow the full functionalities of gold surfaces to enable wide application.

Accordingly, a method for forming a bimetallic core-shell nanostructure is disclosed herein. The bimetallic core-shell nanostructure includes a core including silver and a shell including gold. The method includes simultaneously adding a gold precursor and a reducing agent to a solution containing silver nanoparticles. The reducing agent includes hydroxylamine solution or a hydroxylamine salt.

The method is a straightforward method for Au coating of Ag nanoprism core while advantageously retaining the shape of Ag nanoprism core. The bimetallic core-shell nanostructures formed by the present method have been analyzed using electron microscopic analysis, which confirms the formation of gold layers on all facets of the Ag nanoprism seeds, which leads to a core-shell nanostructure that preserves the optical features of Ag nanoprism core and offers better stability against oxidation and more versatile functionalities than a bare Ag nanoprism core.

A nanostructure is a structure or object that can have any form and has dimensions typically ranging from 1 to a few hundred nm (nanometer). More specifically, a nanostructure has at least one dimension being less than 100 nm. Nanostructures can be classified, for example, into the following dimensional types: zero dimensional (0D) including, but not limited to, nanospherical particles (also called nanospheres); one dimensional (1D) including, but not limited to, nanorods, nanowires (also called nanofibers) and nanotubes; two dimensional (2D) including, but not limited to, nanoflakes, nanodiscs, nanocubes and nanofilms; and three dimensional (3D).

In the present context, the nanostructures are metallic. Specifically, the nanostructure has a core-shell structure whereby the shell encapsulates the core. For example, the shell may encapsulate the core such that 95%, 96%, 97%, 98%, 99%, or more of the exterior surface of the core is coated with the shell. In various embodiments, the shell completely encapsulates the core. More particularly, the core-shell nanostructure is bimetallic whereby the core and shell each include a different metal. The present bimetallic core-shell nanostructure include a silver core and a gold shell encapsulating or surrounding the silver core.

The bimetallic core-shell nanostructure can have a plate-like configuration, whereby the longitudinal dimension is more than the height or thickness of the nanostructure. In various embodiments, the height (or thickness) of the bimetallic core-shell nanostructure may be about 2 to about 100 nm, such as 2 nm, 5 nm, 10 nm, 15 nm, 20 nm, 25 nm, 30 nm, 35 nm, 40 nm, 45 nm, 50 nm, 55 nm, 60 nm, 65 nm, 70 nm, 75 nm, 80 nm, 85 nm, 90 nm, 95 nm, or 100 nm, while the edge length of bimetallic core-shell nanostructure may be about 20 nm to about 200 nm, such as 20 nm, 30 nm, 40 nm, 50 nm, 60 nm, 70 nm, 80 nm, 90 nm, 100 nm, 110 nm, 120 nm, 130 nm, 140 nm, 150 nm, 160 nm, 170 nm, 180 nm, 190 nm, or 200 nm. The thickness of the shell surrounding the core may be substantially uniform. Examples of plate-like configuration may include, but are not limited to, triangular shape, hexagonal shape, or circular shape. Accordingly, the core of the bimetallic core-shell nanostructure may include a triangular prism, hexagonal prism, or circular disc.

By "prism" or "nanoprism" is meant a metal composition that exhibits prismatic properties. In various embodiments, the bimetallic core-shell nanostructures exhibit prismatic properties. For brevity, the present core-shell nanostructures may sometimes be termed simply as nanoprism and the core as nanoprism core, for example. Prismatic properties can be detected using known techniques. Prismatic properties include, but are not limited to, characteristic resonances, such as surface plasmon dipole and quadrupole resonances. In cases where the nanoprism comprises two metals, such as a core metal and a shell metal, the surface plasmon resonances can be related to the thickness of the shell metal of the nanoprisms. Thus, nanoprisms disclosed herein can have plasmon resonances that have been tailored or controlled to specific wavelengths by controlling thickness of the gold shell. In various embodiments, the bimetallic core-shell nanostructure may have a surface plasmon excitation resonance band of 400 nm to 1,300 nm.

The gold precursor can be any gold salt or source of gold ions. The gold precursor is reduced to elemental gold by a suitable reducing agent. In various embodiments, the gold precursor may include chloroauric acid ($HAuCl_4$), gold (III) chloride ($AuCl_3$), gold (I) chloride (AuCl), and a mixture thereof. In one embodiment, the gold precursor may include $HAuCl_4$.

The reducing agent is one that reduces the gold precursor to elemental gold. The reducing agent may be sufficiently mild such that it only reduces the gold precursor and has minimal or no impact on the silver core. In particular, the reducing agent does not etch the silver core such that the silver core retains substantially its original structure or shape. The reducing agent may include hydroxylamine solution (HyA) or a hydroxylamine salt. Present reducing agent exhibits little or no etching of Ag and Au nanocrystals compared to other conventional reducing agents such as ascorbic acid (see Examples described in later section). In various embodiments, 100 mM or less of the reducing agent may be used. For example, 100 mM, 95 mM, 90 mM, 85 mM, 80 mM, 75 mM, 70 mM, 65 mM, 60 mM, 55 mM, 50 mM, 45 mM, 40 mM, 35 mM, 30 mM, 25 mM, 20 mM, 15 mM, 10 mM, 5 mM, 1 mM or even less, such as in the nM (nanomolar) range, of the reducing agent may be used.

As mentioned above, the gold precursor and the reducing agent are added simultaneously (i.e. added at the same time) to the solution containing silver nanoparticles. Since the reducing power of HyA may be enhanced at higher pH, in various embodiments a basic solution may be added to the reducing agent. By increasing the pH of the reducing agent HyA, the rate of deposition of gold onto the silver core may be enhanced. The basic solution may be added to the reducing agent prior to the simultaneous addition of the gold precursor and the reducing agent to the solution containing silver nanoparticles. Alternatively, the gold precursor, the reducing agent, and the basic solution are added simultaneously to the solution containing silver nanoparticles. For the example, the basic solution may include, but is not limited to, sodium hydroxide or potassium hydroxide.

The gold-coating reaction may be carried out at room temperature or lower. At lower temperatures, such as 20° C., 15° C., 10° C., 5° C., or 0° C., better morphology of the resultant bimetallic core-shell nanostructure may be obtained. Thus, in various embodiments, the reaction mixture including the solution containing silver nanoparticles, the gold precursor, and the reducing agent (and also the basic solution, if present) may be placed in a container placed in an ice bath.

To further aid the deposition rate of gold, the reaction may be continuously stirred.

As mentioned above, it is desirable to ensure that the reducing of the gold precursor occurs on the surface of the silver nanoprism core while spontaneous nucleation of gold nanoparticles in the reaction mixture is avoided. Thus, in various embodiments, the reducing agent is added at a flow rate of about 1 to 3 ml/h. For example, the flow rate of adding the reducing agent may be about 1 ml/h, 1.5 ml/h, 2 ml/h, 2.5 ml/h, or 3 ml/h. The reducing agent may be added at a constant flow rate or at a variable flow rate.

Since the gold precursor is also added to the solution containing silver nanoparticles at the same time the reducing agent is added, the flow rate of the gold precursor may be adjusted accordingly and may or may not correspond directly to the flow rate of the reducing agent. In various embodiments, the gold precursor is added at a flow rate of about 1 to 3 ml/h. For example, the flow rate of adding the gold precursor may be about 1 ml/h, 1.5 ml/h, 2 ml/h, 2.5 ml/h, or 3 ml/h. The gold precursor may be added at a constant flow rate or at a variable flow rate.

By the present method, a tunable gold shell thickness coated on the silver core can be obtained. The method includes controlled deposition of gold atoms on all the surfaces of the silver core to increase their stability and adding more functionality to the unstable silver nanoparticle. Advantageously, the morphology of the silver core remains substantially the same throughout the entire coating process with minimal or no etching by the gold ions.

In order that the invention may be readily understood and put into practical effect, particular embodiments will now be described by way of the following non-limiting examples.

EXAMPLES

Example 1

Figure 7:
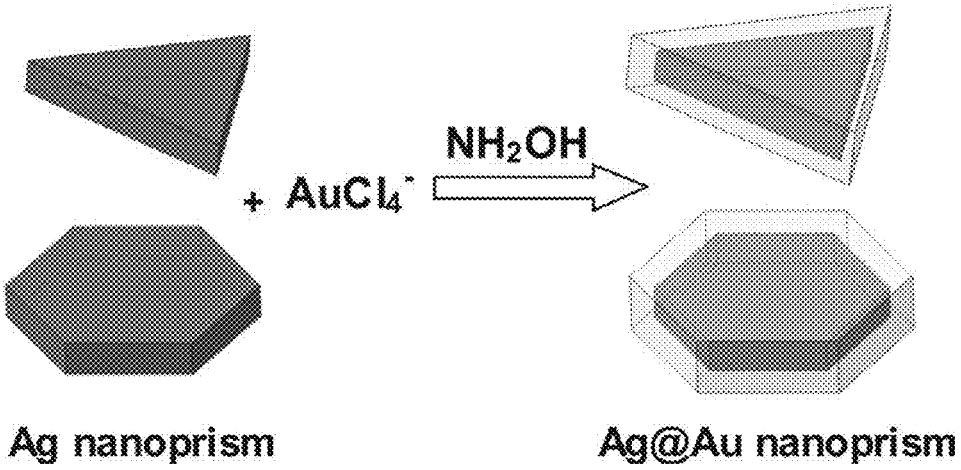
FIG. 7 shows schematic illustration of the gold coating process of silver nanoprisms.

In this example, the main goal is to utilize readily available reagents to coat Ag nanoprisms with a thin layer of gold, while preserving the prism shape and minimizing the Ag prism etching by gold precursor ions ($AuCl_4^-$ and $AuCl_2^-$). We use a straightforward seed-mediation approach that involves hydroxylamine (HyA) to reduce the gold salt (see FIG. 7). The reaction is very mild to ensure epitaxial gold growth on the Ag nanoprism and also to guarantee that the reduction of gold salts only occurs on the surface of Ag nanoprism seeds and spontaneous nucleation of gold NPs is avoided. In addition, it is notable that HyA exhibits little etching of silver and gold nanocrystals when compared with other mild reducing agent such as ascorbic acid, which has been reported to show etching on silver nanoprisms and gold nanorods.

Synthesis of Silver Nanoparticles.

In a typical synthesis, Millipore water (190 mL), $AgNO_3$ (1 mL, 30 mm), and sodium citrate (2 mL, 25 mm) were combined in a 500-mL three-necked flask. The flask was immersed in an ice bath, and the solution was bubbled with nitrogen gas under vigorous stirring for 30 minutes. $NaBH_4$ (1 mL aqueous solution, 70 mM, freshly prepared with ice-cold water) was rapidly injected into the solution. Over the next 20 min, five drops of the $NaBH_4$ solution were added into the solution every 2 min. Then 1 mL solution of bis(p-sulfonatophenyl)phenylphosphine dihydrate dipotassium (5 mM) and 1 mL $NaBH_4$ solution were added dropwise into the reaction mixture. The resulting solution of silver nanoparticles was gently stirred for 3 h in the ice bath and allowed to age overnight at about 4° C. in the dark.

Photomediated Preparation of Silver Nanoprism.

In a typical experiment, the silver nanoparticle solution (20 mL) was irradiated with a halogen lamp (150 W) coupled with an optical bandpass filter centered at 600±20 nm. The photoreaction was monitored by UV-Vis spectroscopy, and stopped when the major extinction band at about 700 nm showed no more obvious changes.

Synthesis of Triangular Ag@Au Nanostructure.

The as-prepared Ag nanoprism solution (15 mL) was added into 20 mL of Millipore water in a glass vial placed in an ice bath, followed by infusion of ca. 2-4 mL solution of about 1 to 100 mM, such as 3 mm HyA and ca. 2-4 mL solution of 0.27 mm $HAuCl_4$ into the solution through two separate tubes on a mechanical syringe pump with vigorous stirring. The infusion rate was set as 1-3 mL h−1. Basic HyA solution was prepared by adding 200 μL NaOH (0.5 m) into 6 mL as-prepared HyA solution.

Sample Preparation for Electron Microscopy.

Samples were prepared for electron microscopy by drying a drop of nanoprism solution on a carbon-coated copper grid or a $SiO_2$-supported TEM grid (Ted Pella, Inc.). For flat-lying nanoprisms, the TEM grid was pretreated with 0.1 wt % solution of polyethylenimine (PEI) prior to drying the nanoprism solution on the surface. For standing nanoprisms, the nanoprisms were resuspended in ethanol before deposition and drying on the TEM grid.

Electron Microscopic Characterization.

TEM measurements were carried out on a JEOL JEM-2010 TEM or a JEM-2100F TEM at an operation voltage of 200 kV. The HAADF-STEM imaging was carried out on a FEI Titan TEM with a Schottky electron source and an operation voltage of 200 kV. STEM images were obtained by using an electron probe with an approximate diameter of 0.2 nm. EDX line-scan profiles were taken by using a probe diameter of ca. 0.5 nm with 5 s acquisition time for each spectrum.

The gold coating process was carried out by slowly introducing $HAuCl_4$ and HyA simultaneously into the Ag nanoprism solution through two separate tubes on a mechanical syringe pump. Throughout the whole process, the solution was kept under vigorous magnetic stirring. The synthetic route has four different stages as summarized in Table 1. Since the reducing power of hydroxylamine is enhanced at higher pH values, in stage 2 we introduced some NaOH into the hydroxylamine solution to increase pH and boost the gold deposition rate. As the LSPR bands of gold and silver NPs are highly sensitive to changes in their size and shape, we are able to track and evaluate the structure evolution during the coating process based on the extinction spectra of the NPs. To monitor the gold coating process, an aliquot of the solution was taken at 15-min intervals during the reaction for characterization by UV-Vis spectroscopy and transmission electron microscopy (TEM).

TABLE 1

Different experimental stages of the gold coating process.

| Stage | Duration of stage [min] | Rate [mL $h^{-1}$] | Reducing agent | [$HAuCl_4$] [mM] |
|---|---|---|---|---|
| 1 | 0-30 | 1.00 | Standard $NH_2OH$•HCl | 0.2748 |
| 2 | 30-120 | 1.00 | Basic $NH_2OH$•HCl | 0.2748 |
| 3 | 120-135 | 3.00 | Standard $NH_2OH$•HCl | 0.2748 |
| 4 | 135-200 | 1.00 | 3× Standard $NH_2OH$•HCl | 3 × 0.2748 |

Figure 2:
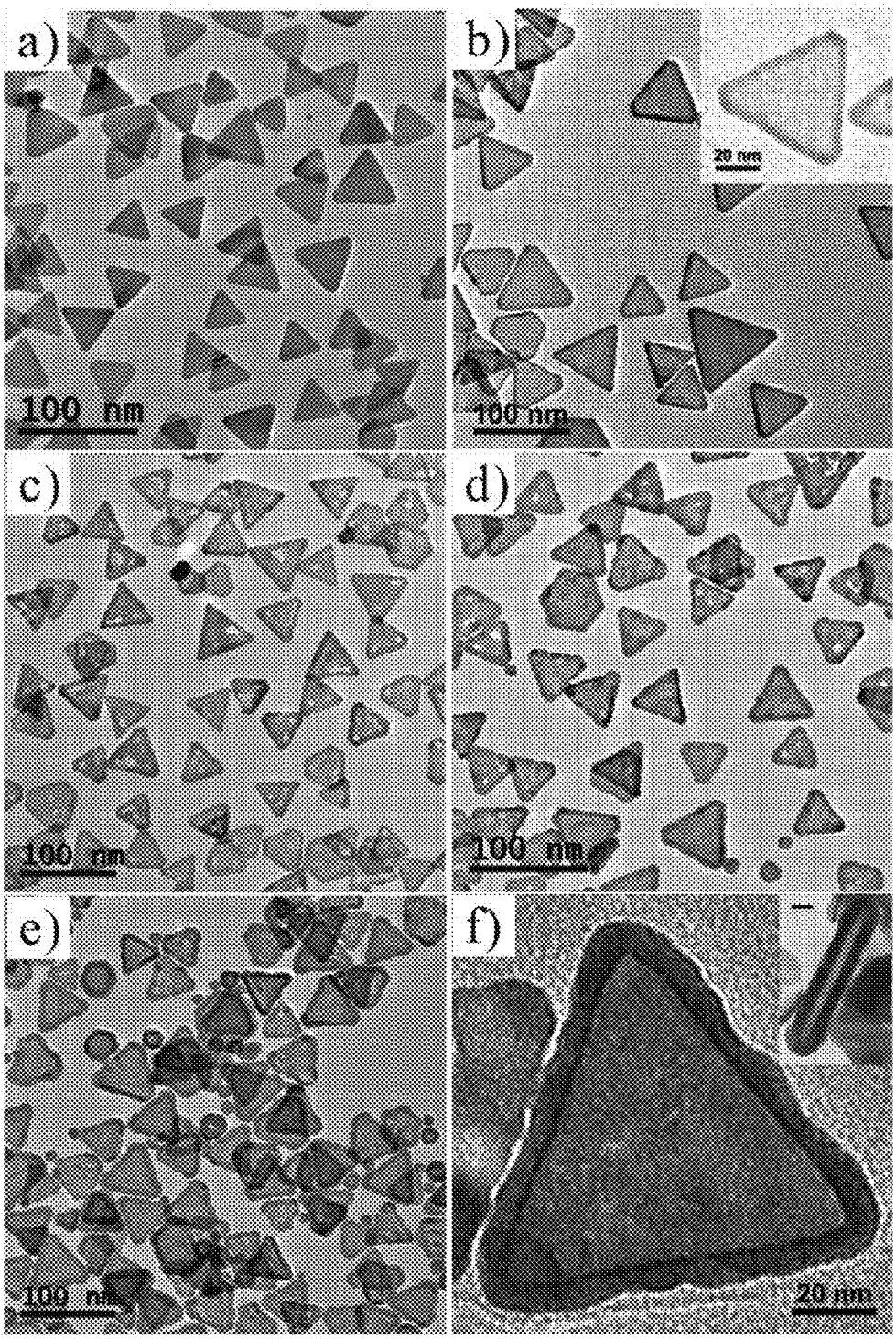
FIG. 2 shows TEM images of a) initial silver nanoprisms; b) samples at 45 min with gold deposition on the prism edges; c) samples from stage 2 with some small pinholes; d) samples with partially refilled pinholes after 120 min (stage 3); e) samples at 200 min with full gold shells (stage 4); f) a typical final gold-coated nanoprism (the inset is the cross-sectional view with a scale bar of 10 nm).

FIG. 1 indicates that in the first stage the LSPR band red-shifts and increases in intensity with time. This result corresponds to an initial Au deposition on the Ag prism edges, which makes the edges show up with greater contrast under TEM observation (FIG. 2*b*). This deposition is due to the high surface energy of the (110) planes on the Ag prism edges, so that gold atoms deposit preferentially on these sites. A further red-shift of the LSPR band with dampening intensity is attributed to (111) face etching of Ag prisms by $HAuCl_4$. Consistently, FIG. 2*c* shows that some areas on the triangular surface exhibit less contrast and small pinholes appear in the prism structure. This etching process is known as galvanic replacement, and it preferentially occurs on the (111) plane when the gold salt concentration reaches a certain value. This process indeed reduces the thickness of some areas of the Ag prisms, causing a red-shift of the LSPR band, and eventually creates pinholes while the gold-coated edges remain undamaged.

In stage 3, we observed a progressive blue-shift with increasing intensity of the LSPR band. TEM analysis revealed that the etched areas on the triangular plane are refilled with Au and Ag alloy (FIG. 2*d*), and this process is followed by continuous pure gold deposition towards a fully gold-coated prism structure (FIG. 2*e*-2*f*). The backfilling process refills the pinholes and recovers the prism thickness, which results in a blue-shift of the LSPR band. The steady increase of LSPR intensity indicates that the prism edge length also increases. To obtain a clearer view of the LSPR band correlated with the structural changes at different stages, the evolution of LSPR band during the entire gold coating process is depicted in FIG. 1*b* in terms of peak evolution.

Structure Analysis of Gold-Coated Silver Nanoprisms.

Figure 3:
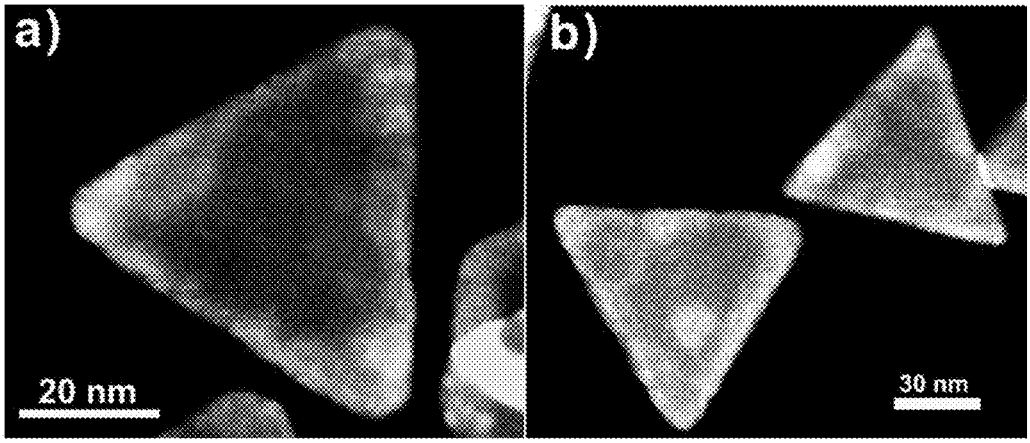
FIG. 3 shows a) HAADF-STEM image at 45 min, showing obvious deposition of gold on the edges of silver nanoprisms. b) HAADF-STEM image at 60 min, showing the deposition of gold on the prism edges with spread into the (111) facet.

Detailed microscopic analyses were carried out for the product at each growth stage to obtain convincing evidence of the structures. The average edge length and thickness of the Ag nanoprisms before gold deposition were measured as 56 and 6 nm, respectively. At the early stage, when gold starts to deposit on the Ag prism edges, the contrast between Ag and Au may not be clearly distinguishable under normal bright-field TEM mode for some samples (FIG. 2*b*), hence we used the high-angle annular dark-field scanning transmission electron microscopy (HAADF-STEM), where the signal contrast is proportional to the atomic number (Z). The large difference in Z values between Ag (47) and Au (79) allows distinct differentiation of these two elements. As shown in FIG. 3*a*, the clear bright edges of the prisms in dark-field mode indicate the Au coating on the edges of the prisms after the first 45 min of the reaction. This gold coating further tends to spread into the center of the triangular plane by 60 min in the coating process (FIG. 3*b*). The energy-dispersive X-ray spectroscopic (EDX) line-scan examinations of the prisms from the side view (FIG. 4*b* and FIG. 4*c*) reveal that the triangle surface consists of both Ag and Au, which suggests that the surface consists of an alloy.

Figure 5:
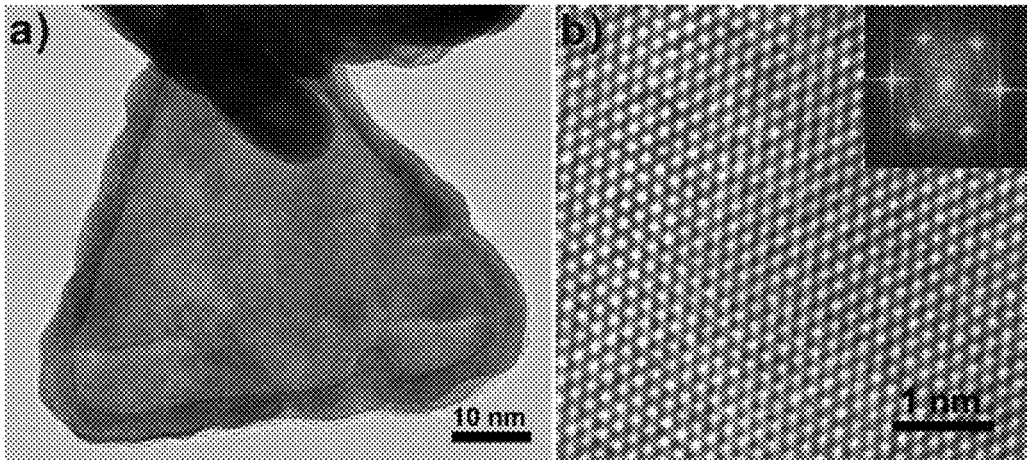
FIG. 5 shows a) TEM image of the Ag@Au core-shell nanoprism. b) HRTEM image taken along a direction perpendicular to the flat top faces. The inset fast Fourier-transformed (FFT) patterns shows six-fold hexagonal symmetry corresponding to the (111) plane.
Figure 4:
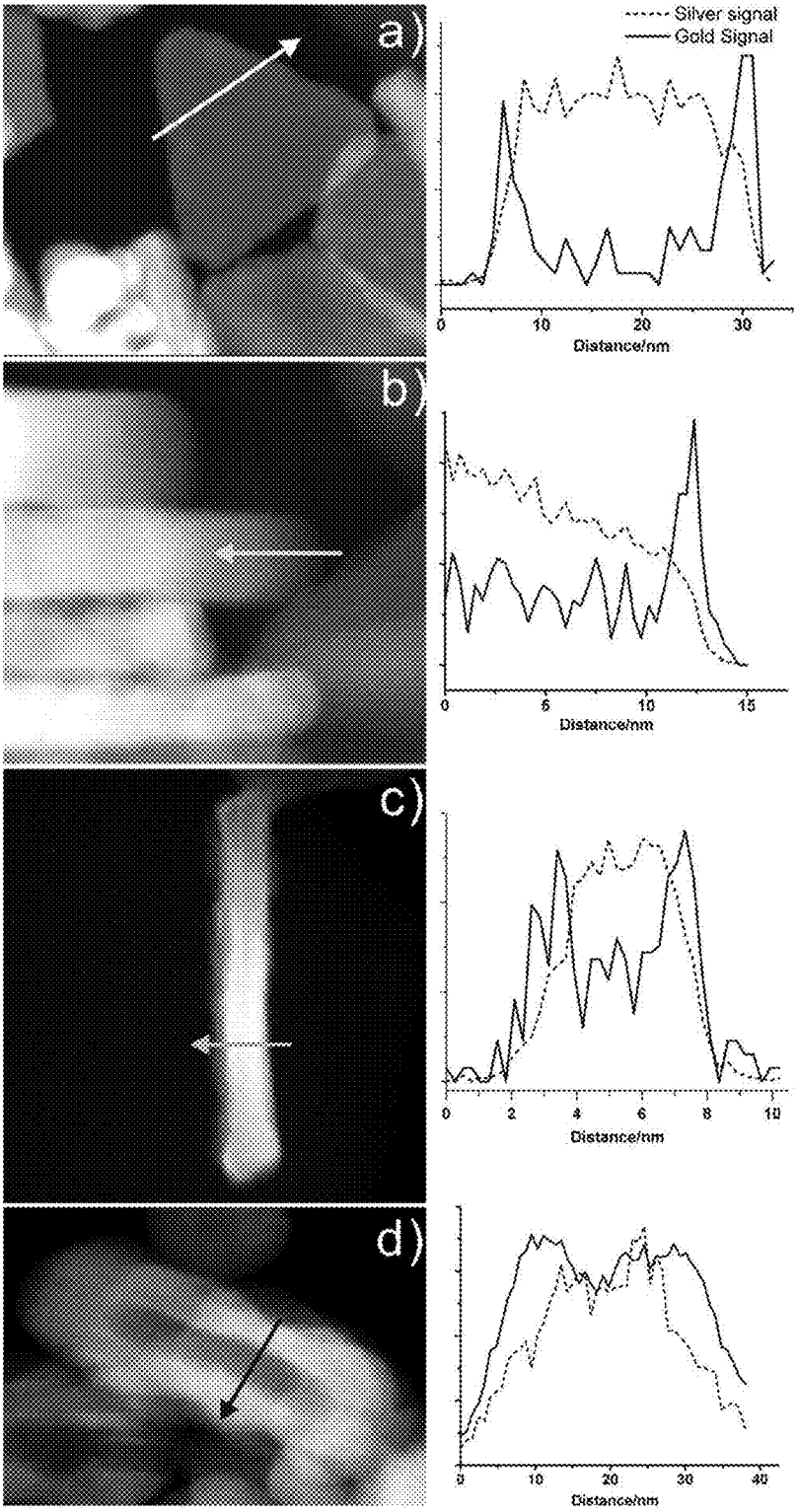
FIG. 4 shows STEM images and EDX line-scan profiles of Ag@Au nanorisms at 60 min (a-c) and 200 min (d).

However, the final structure of the gold-coated silver nanoprism exhibits a fully gold-coated surface, as shown in the EDX profile of the edge (FIG. 4*d*). After the coating process, the prism thickness can increase up to 17 nm while the initial thickness is characterized as 6 nm. High-resolution TEM (HRTEM) examination (FIG. 5) shows that the core-shell structure is still single-crystal and the triangle face is still a (111) plane with a close-packed hexagonal lattice. X-ray photoelectron spectroscopy (XPS) analyses were carried out to further confirm the gold coating. When these core-shell triangular nanocrystals are sputtered with $Ar^+$ ions, the Au/Ag ratio firstly decreases and then increases, which is in accordance with a sandwich morphology of the Ag@Au nanoprisms in the cross-section. This result reinforces the conclusion that we have formed a complete gold coating as the outermost layer of the nanoprism.

Discussion on the Growth Stages.

Based upon the TEM analysis of the samples taken during the gold-coating process, a general trend of morphological changes can be observed for the formation of Ag@Au core-shell nanoprisms. This formation includes four main growth stages:

i) Initial Deposition of Au Atoms on the Silver Nanoprism Edges:

At the very beginning, the $HAuCl_4$ concentration is too low to induce noticeable etching while the deposition of Au atoms on the Ag nanoprism (110) and (100) facets still proceeds, as the high surface energy of these facets enables effective activation of the reaction between HyA and $HAuCl_4$. The initial Au deposition on the nanoprism edges is similar to the epitaxial Au growth reported by others, where formation of a gold layer along the Ag nanoprism edges was observed by using l-ascorbic acid as the reducing agent. It has been proposed by others that the initial Au layer deposited onto the Ag nanoprism edges can protect the prism edges against etching by and $AuCl^{4-}$. The chemical reactions involved in the initial gold coating process are believed to occur as follows (Equations 1 and 2).

$$6NH_3OH^+ \leftrightarrow 6e^- + 12H^+ + 6H_2O + 3N_2 \quad (1)$$

$$2Au^{3+} + 4e^- \rightarrow 2Au^+$$

$$2Au^+ + 2e^- \rightarrow 2Au^0 \quad (2)$$

ii) Etching of Nanoprism (111) Facets:

As the $HAuCl_4$ concentration increases, the (111) facets start to be etched through galvanic corrosion, while the Ag nanoprism edges are protected by the initially deposited Au layers. The etching is due to the difference in the redox potentials between $Ag^+/Ag$ (0.8 V vs. SHE; SHE=standard hydrogen electrode) and $AuCl_4^-/Au$ (0.99 V vs. SHE), which leads to the oxidation of Ag nanoprisms by gold ions. In this stage, if the silver etching rate is uncontrollably fast, some random structures can be observed, including semi-hollow structures with lots of pinholes, and small broken pieces of nanoprisms. This template-engaged replacement reaction could be described according to Equation 3.

$$3Ag(s) + AuCl_4^-(aq) \rightarrow Au(s) + 3Ag^+(aq) + 4Cl^-(aq) \quad (3)$$

iii) Backfilling of the Etched Pinholes with Ag—Au Alloy:

The etched (111) facets of Ag prisms are backfilled with Ag—Au alloy at this stage. In the TEM observation, these nanoprisms often exhibit varied contrast in the backfilled pinhole sites (FIG. 2*d*). The primary reaction observed in the backfilling process is gold deposition onto the inner edges of the pinholes without altering the nanoprism thickness. Hence the backfilling is believed to be face-selective. Due to the large roughness at the inner edges of pinholes, these sites possess higher surface energy than the outer prism edges and flat surface sites. Thus gold deposition occurs predominantly at the inner edges to minimize surface energy. Meanwhile, in the presence of the mild reducing agent HyA, the Ag nanoprism would act as an electron-transfer mediator to catalyze the reduction of gold ions as well as the silver ions from oxidatively etched Ag prisms to deposit on the prism surfaces. This seed-mediated deposition process can be illustrated as in Equations 4 and 5, where Agx and AgxAuy represent pure Ag nanoprisms and bimetallic nanocrystals, respectively.

$$Ag_x(s) + AuCl_4^-(aq) + 3e^- \rightarrow Ag_xAu(s) + 4Cl^-(aq) \quad (4)$$

$$Ag_xAu_y(s) + AuCl_4^-(aq) + 3e^- \rightarrow Ag_xAu_{y+1}(s) + 4Cl^-(aq)$$

$$3Ag(s) + AuCl_4^-(aq) \rightarrow Au(s) + 3Ag^+(aq) + 4Cl^-(aq)$$

$$Ag_xAu_y(s) + Ag^+(aq) + e^- \rightarrow Ag_{x+1}Au_y(s) \quad (5)$$

Figure 6:
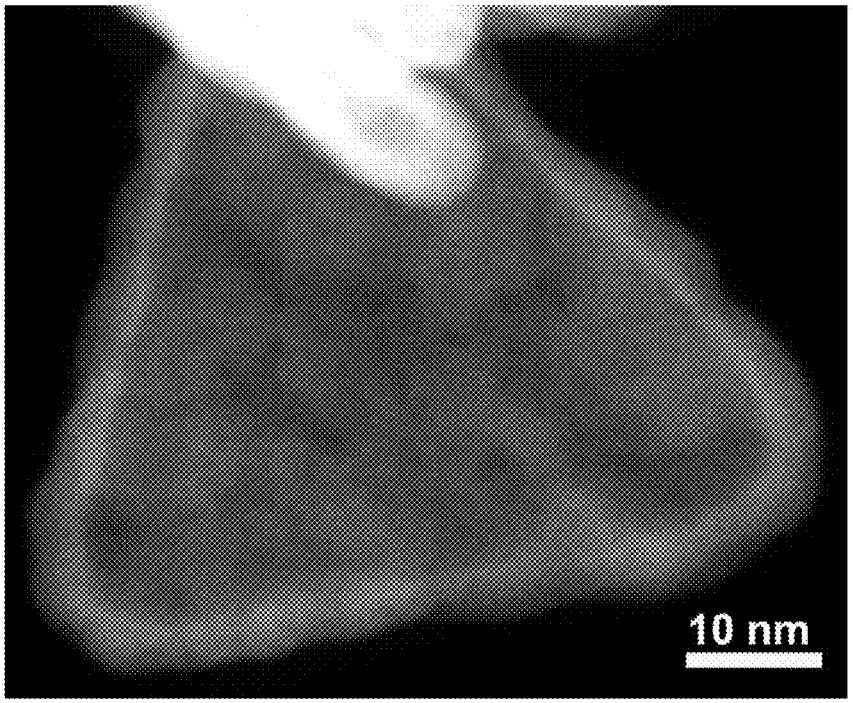
FIG. 6 shows HAADF-STEM image of a fully gold-coated prism at 200 min.

In fact, Equation (4) represents a bimetallic growth towards higher atomic Au ratio, while the reaction in Equation (5) shows the possibility of co-reduction of $Ag^+$ ions that comes from the etching of Ag nanoprisms by the gold ions. The concurrence of these reactions leads to Ag—Au alloy deposition in the refilling process. To get a final shell of pure gold, the reaction in (4) has to be much faster than that in (5), which is achieved by appropriately increasing the reagents' infusion rate and solution pH. The characterization results indicate that by successive formation of thin bimetallic (AgxAuy) shells on the Ag nanoprism surface with continuous increase of the y/x ratio, a pure gold shell will eventually form on the outermost layer of the Ag@Au nanoprisms.

iv) Further Gold Deposition on all Facets of the Prisms to Form Fully Gold-Coated Nanoprisms:

After the pinholes are completely backfilled, further gold deposition takes place on all nanoprism surfaces including tips, edges, and triangular faces. From the HAADF-STEM image (FIG. 6), we can observe that the brightness of the (111) triangular face decreases due to a thickness increment from pure gold deposition and the higher atomic number of gold than silver. The fully gold-covered Ag nanoprisms are quite stable and show excellent etching resistance to $HAuCl_4$. The morphology of these gold-coated nanoprisms remained unchanged even after six months. In addition, if the Au deposition rate is uncontrollably fast in this stage, we could observe wavy and dendritic structures, which are not favored.

Figure 8:
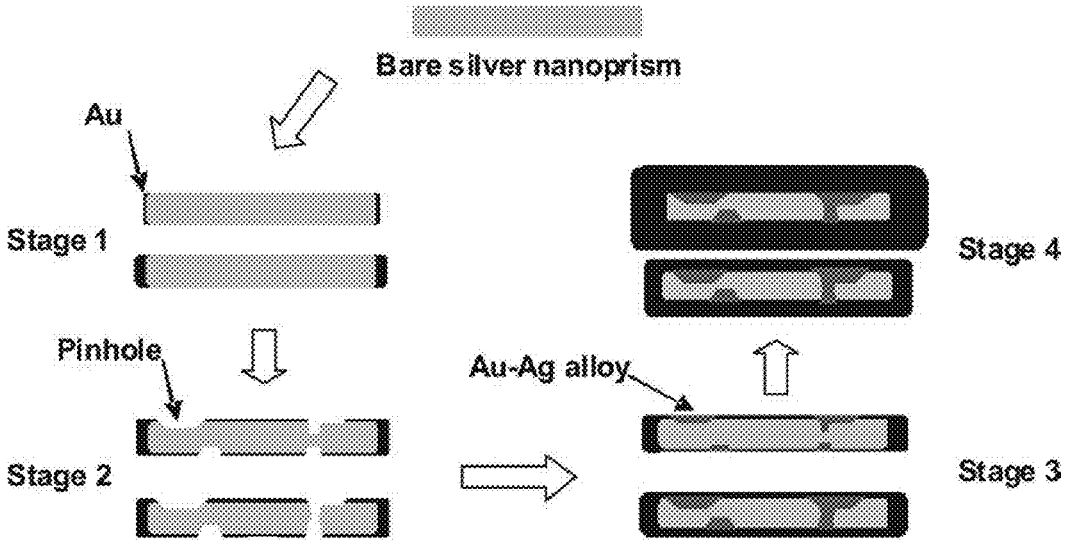
FIG. 8 shows schematic illustration of the formation of Ag@Au core-shell nanoprisms, showing a cross-sectional view of a typical growing core-shell Ag@Au nanoprism and the manner of its growth. At the beginning gold ions are reduced and deposited as Au atoms at the edges of Ag nanoprisms (Stage 1). The Ag prism oxidation is indicated by pin-hole formation, while most Ag prisms remain (Stage 2). In Stage 3 more Au atoms are deposited, along with co-reduction of $Ag^+$ to form an alloy surface but with increasingly larger Au ratio. Finally, in Stage 4, the Ag@Au nanoprisms with full gold shells grow with increments in both edge length and thickness due to gold deposition on all prism facets.
Figure 9:
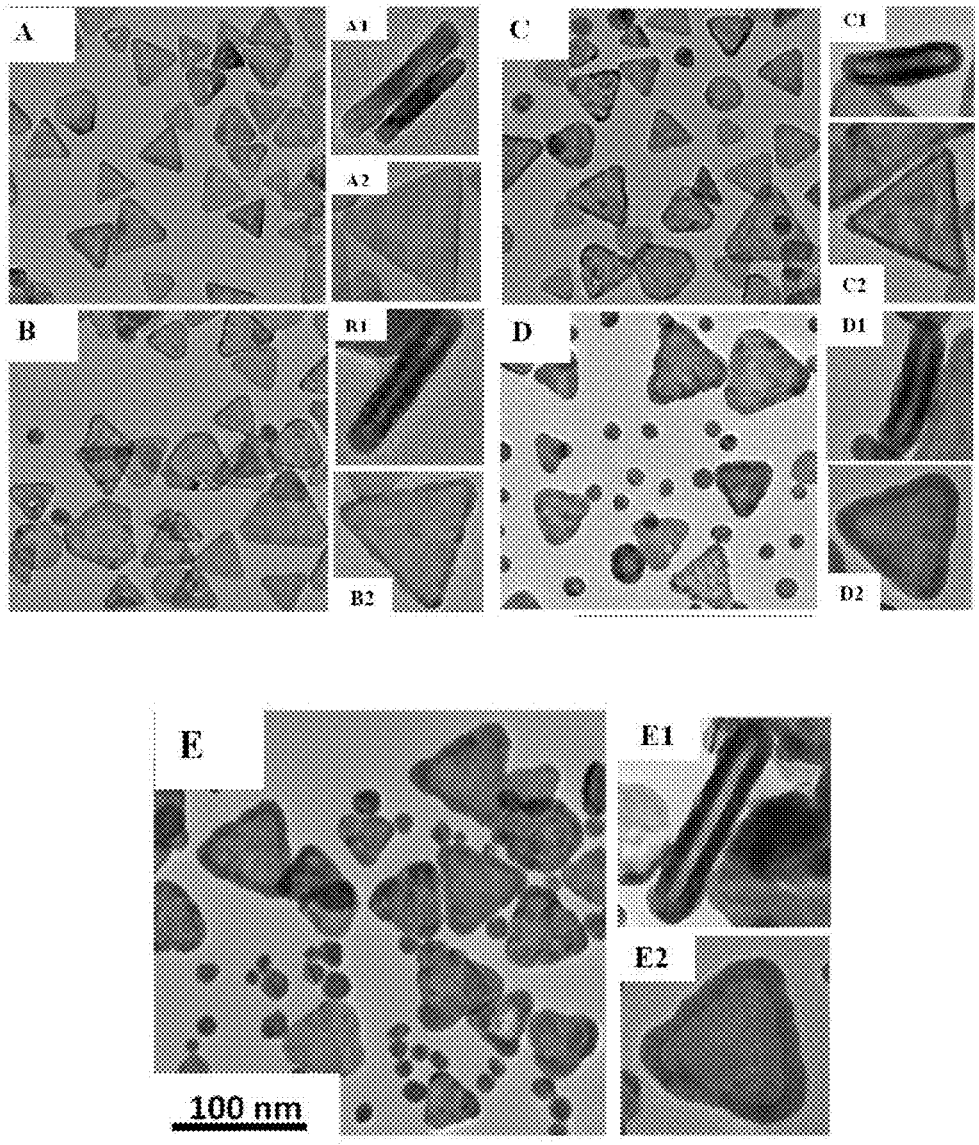
FIG. 9 shows TEM images of core-shell nanoparticles. A) Initial deposition of gold on the edges of silver nanoprism and slight pinhole etching after 60 min. (In all X1 and X2 images corresponds to the cross section and flat-lying particles, respectively). B) Formation of more pinholes and their refilling after 150 min. C) Pinhole-refilled particles with gold after 200 min. D) Non-uniform shell of gold on the silver nanoprism template after 230 min. E) Thick and uniform shell of gold on the silver nanoprism at 265 min. Scale for right and left column is depicted at the bottom of the each column.
Figure 10:
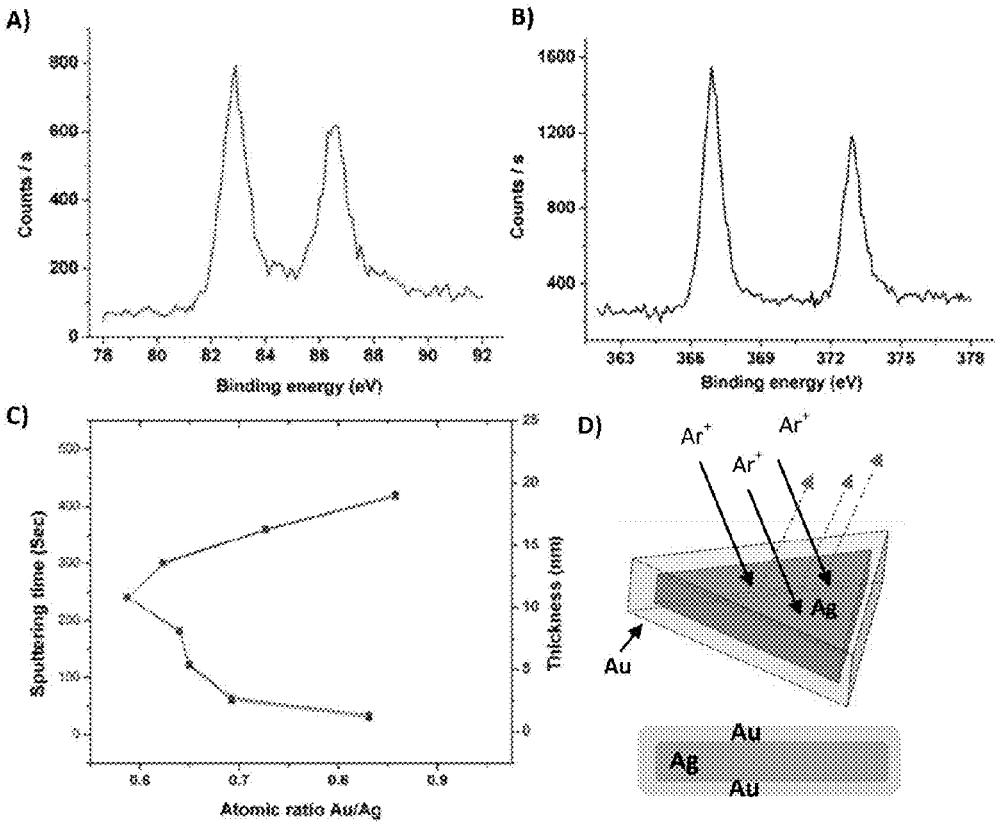
FIG. 10 shows X-ray photoelectron spectroscopy (XPS) analysis of an Ag@Au triangular nanoprism. A) High resolution scan related to Au4f. B) High resolution scan related to Ag3d. C) plot of atomic ratio of Au/Ag versus sputtering time. The Au/Ag ratio on the nanocrystal surface decreases with sequential $Ar^+$ sputtering (with sputtering rate of 2.7 nm/min) on top side of the core-shell structure and on the bottom side increase do to symmetry of structure in cross sectional view, consistent with the TEM observation in which the Au exists in the outmost layers of the Ag nanoprisms. The atomic ratio of Au/Ag decreases by time with respect to the fast diffusion of gold and silver. Herein an Au/Ag ratio of 0.85 was obtained at 8 days after the structure synthesis but graph above still indicating that the surface is dominated by the coated Au. The low ratio, (Au/Ag)<1, is attributed to high diffusion rate between Ag and Au atoms at room temperature due to low diffusion energy barrier (0.1 eV). For XPS, samples were transferred to an analysis chamber equipped with an X-ray photo-electron spectrometer (Thermo Fisher Scientific Theta Probe). Theta probe XPS sputtering rate (based on $TaO_2$) applied at 2.7 nm/Min in the sputtering condition of 3 KeV, 1 μA and working area of 4 mm*4 mm. An Al Kα (1486.5 eV) anode with a power of (15 kV) 100 W was used. XPS spectra were gathered using a hemispherical energy analyzer operated at pass energy of 20.0 eV for elemental analysis.
Figure 11:
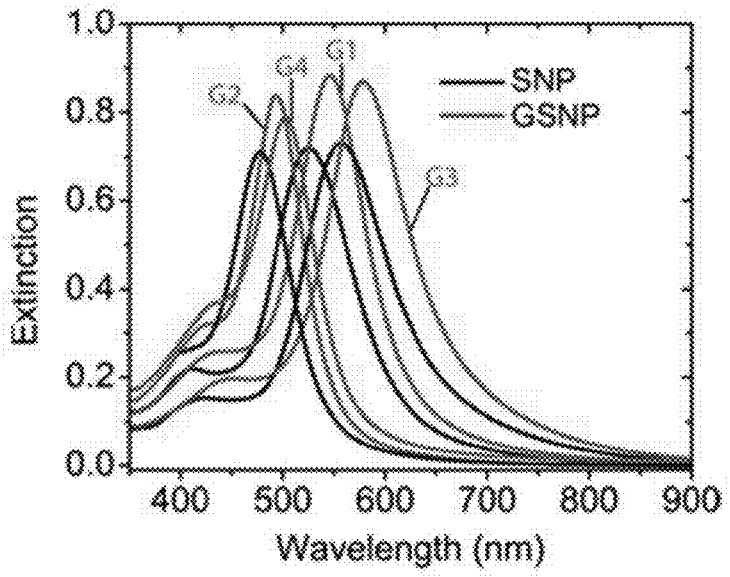
FIG. 11 shows (a) Extinction spectra of four batches of GSNP samples (red line) and SNP samples used as precursors (SNP). (b) schematic illustration of the P3HT:PCBM polymer coating on GSNPs that are assembled on an APTMS-functionalized glass substrate of Example 2.
Figure 11:
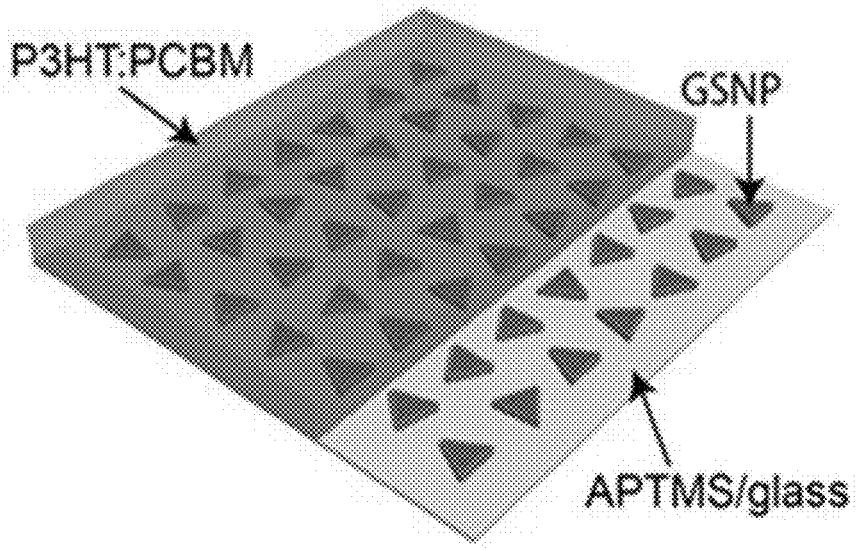
Figure 12:
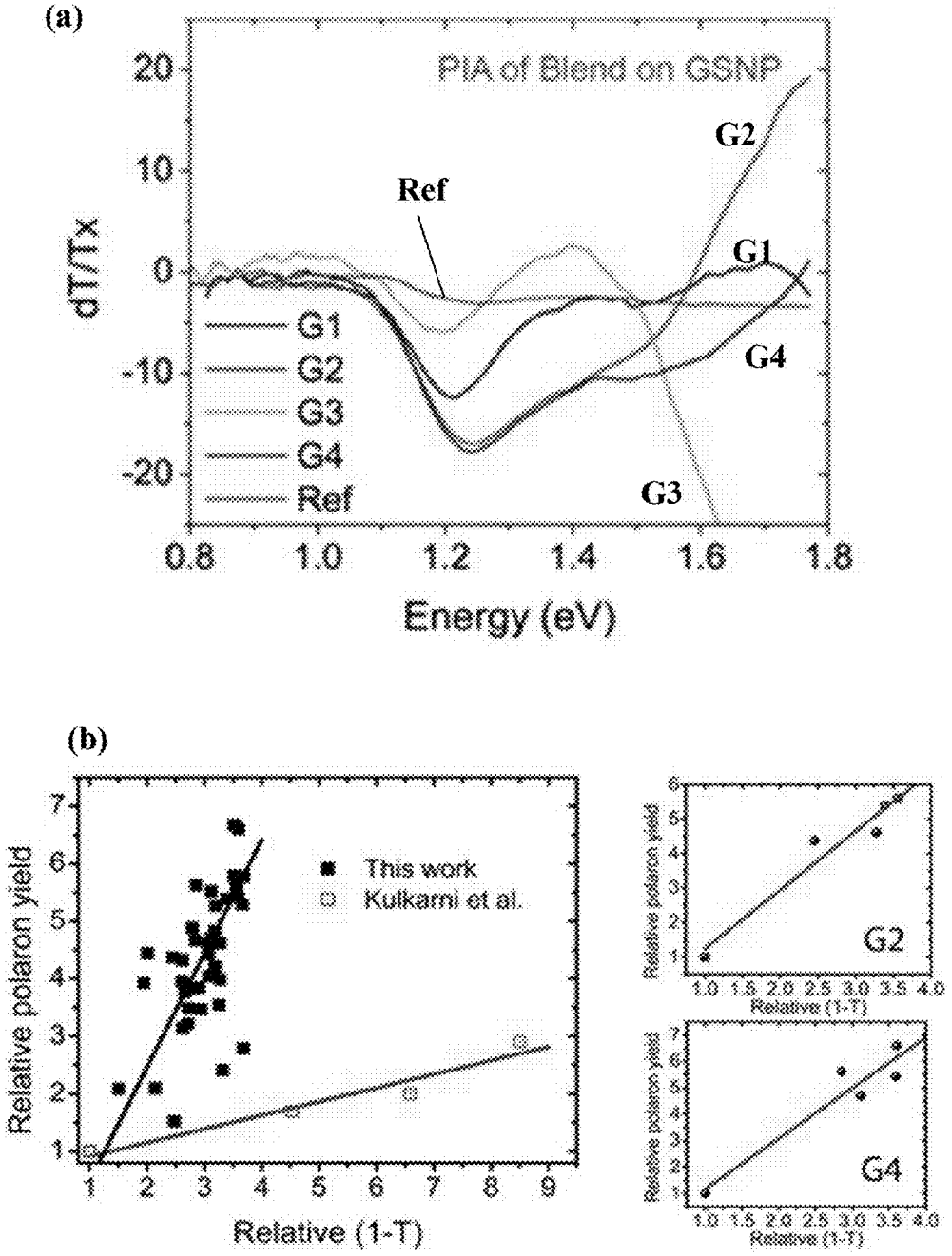
FIG. 12 shows (a) typical PIA spectra of different GSNP sample coated with P3HT:PCBM. (b) calculated relative polaron yield (based on PIA spectrum) enhancement by GSNP at different GSNP density on the glass substrate of Example 2.

To better illustrate these four different stages of gold coating, a schematic diagram of the growth model from the cross-sectional view is depicted in FIG. 8. It should be noted that these four growth stages may overlap, particularly at the end of each stage.

Conclusion.

In summary, we present a surfactant-free gold-coating process of Ag nanoprisms with systematic structural studies on the resulting Ag@Au core-shell nanoprisms. The results presented here are important as they demonstrate the first successful attempt to produce fully gold-coated core-shell structures from Ag nanoprism templates while maintaining the prism morphology and controllable Au shell thickness. The pure gold shell on the nanoprism surface provides strong stability against etching. TEM analyses prove that the structure is a core-shell nanoprism rather than a nanobox or nanocage. The LSPR band of the resultant core-shell prism structures could be tuned from 550 to 1100 nm by controlling the Au shell thickness. More importantly, these gold-coated nanoprisms have very clean surfaces and are free from strong binding surfactants, which endows easier and more flexible functionality for a large number of potential applications in biosensing and bioimaging.

Example 2

In this example, plasmon-enhanced charge carrier generation by gold-coated silver nanoprism is demonstrated. We assembled the gold-coated silver nanoprism (GSNP) on a glass substrate, and coated the GSNP layer with P3HT/PCBM polymer blend that is typically used for organic solar cells. Then we use photoinduced absorption (PIA) spectroscopy to study the plasmon-enhancement on charge carrier generation.

PIA monitors the change in transmittance of the blend film upon photoexcitation and provides a quantitative spectroscopic fingerprint of long-lived polarons. By comparing the magnitude of the P3HT polaron peak through PIA in the absence and presence of nanoprisms, we can quantify the occurrence of plasmon-enhanced charge carrier generation since the strength of the photoinduced absorption at the polaron peak is proportional to the number of positive polarons generated by photoexcitation.

We utilized four batches of GSNP samples (G1 to G4) with different plasmon absorption band. Stronger charge carrier enhancement is observed when the SPR band of GSNP (G2 and G4) has larger spectral overlap with the P3HT absorption. We also demonstrate that GSNP exhibits up to 7 times enhancement on the polaron yield, which is much better than previous reports by others. The better enhancement benefits from superior stability of GSNP than bare silver nanoprisms and the tunable SPR band of GSNP that allows us to match the absorption of various active polymers for OPV. Therefore, the GSNP has great potentials for OPV to enhance solar energy conversion efficiency.

By "comprising" it is meant including, but not limited to, whatever follows the word "comprising". Thus, use of the term "comprising" indicates that the listed elements are required or mandatory, but that other elements are optional and may or may not be present.

By "consisting of" is meant including, and limited to, whatever follows the phrase "consisting of". Thus, the phrase "consisting of" indicates that the listed elements are required or mandatory, and that no other elements may be present.

The inventions illustratively described herein may suitably be practiced in the absence of any element or elements, limitation or limitations, not specifically disclosed herein. Thus, for example, the terms "comprising", "including", "containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the inventions embodied therein herein disclosed may be resorted to by those skilled in the art, and that such modifications and variations are considered to be within the scope of this invention.

By "about" in relation to a given numerical value, such as for temperature and period of time, it is meant to include numerical values within 10% of the specified value.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other embodiments are within the following claims and non-limiting examples. In addition, where features or aspects of the invention are described in terms of Markush groups, those skilled in the art will recognize that the invention is also thereby described in terms of any individual member or subgroup of members of the Markush group.

The invention claimed is:

1. A method for forming a bimetallic core-shell nanostructure, wherein the core comprises silver and the shell comprises gold, the method comprising forming a pure gold shell on a silver nanostructure core by simultaneously adding a gold precursor at a flow rate of about 1 to 3 ml/h and a reducing agent at a flow rate of about 1 to 3 ml/h to a solution containing silver nanoparticles, wherein the reducing agent comprises hydroxylamine solution or a hydroxylamine salt.

2. The method of claim 1, wherein prior to or during adding the reducing agent, a basic solution is added to the reducing agent.

3. The method of claim 1, wherein a reaction mixture comprising the solution, the gold precursor, and the reducing agent is placed in a container placed in an ice bath.

4. The method of claim 1, wherein the reaction mixture is continuously stirred.

5. The method of claim 1, wherein the flow rate of the reducing agent is variable.

6. The method of claim 1, wherein the flow rate of the gold precursor is variable.

7. The method of claim 1, wherein the gold precursor is selected from the group consisting of chloroauric acid ($HAuCl_4$), gold (III) chloride ($AuCl_3$), gold (I) chloride ($AuCl$), and a mixture thereof.

8. The method of claim 1, wherein the reducing agent has a concentration of 100 mM or less.

9. The method of claim 8, wherein the concentration of the reducing agent is 10 mM or less.

* * * * *